United States Patent [19]

Speier et al.

[11] Patent Number: 4,895,113

[45] Date of Patent: Jan. 23, 1990

[54] DEVICE FOR RELATIVE ANGULAR ADJUSTMENT BETWEEN TWO DRIVINGLY CONNECTED SHAFTS

[75] Inventors: Wolfgang Speier, Tübingen; Josef Schmitz, Scheidegg, both of Fed. Rep. of Germany

[73] Assignee: Daimler-Benz AG, Stuttgart, Fed. Rep. of Germany

[21] Appl. No.: 330,459

[22] Filed: Mar. 30, 1989

[30] Foreign Application Priority Data

Mar. 30, 1988 [DE] Fed. Rep. of Germany ..... 3810804

[51] Int. Cl.[4] ..... F01L 1/34; F01L 1/04; F16D 3/10

[52] U.S. Cl. ..... 123/90.17; 123/90.31; 464/2

[58] Field of Search ..... 123/90.12, 90.13, 90.15, 123/90.17, 90.31; 464/2, 160

[56] References Cited

U.S. PATENT DOCUMENTS

| | | | |
|---|---|---|---|
| 4,231,330 | 11/1980 | Garcea | 123/90.15 |
| 4,305,366 | 12/1981 | Imasato et al. | 464/2 |
| 4,421,074 | 12/1983 | Garea et al. | 123/90.15 |
| 4,535,731 | 8/1985 | Banfi | 123/90.17 |
| 4,601,266 | 7/1986 | Oldfield et al. | 464/2 |
| 4,787,345 | 11/1988 | Thoma | 123/90.17 |
| 4,811,698 | 3/1989 | Akasaka et al. | 123/90.31 |

FOREIGN PATENT DOCUMENTS

| | | |
|---|---|---|
| 3126620 | 2/1982 | Fed. Rep. of Germany . |
| 3316162 | 11/1983 | Fed. Rep. of Germany . |
| 3619956 | 12/1987 | Fed. Rep. of Germany . |

*Primary Examiner*—Willis R. Wolfe
*Assistant Examiner*—Weilun Lo
*Attorney, Agent, or Firm*—Barnes & Thornburg

[57] ABSTRACT

A device for providing angular adjustment between two drivingly connected shafts utilizes a positioning piston which can be moved axially between a driven sprocket wheel carrier and a flanged shaft connected to a camshaft so as to divide a hollow space formed by sprocket wheel carrier and flanged shaft into two working spaces. The positioning piston is positively connected both to the sprocket wheel carrier and to the flanged shaft via helical toothings. Depending on the position of a control piston arranged in the hollow flanged shaft, pressure oil is channelled out of the engine oil circuit into into one working space or the other and displaces the positioning piston in the axial direction. Via the two helical toothings, this longitudinal displacement of the positioning piston brings about a relative rotation of the camshaft with respect to the driven sprocket wheel carrier. Adjustment in both directions is effected by a hydraulic arrangement alone, without any auxiliary force.

8 Claims, 3 Drawing Sheets

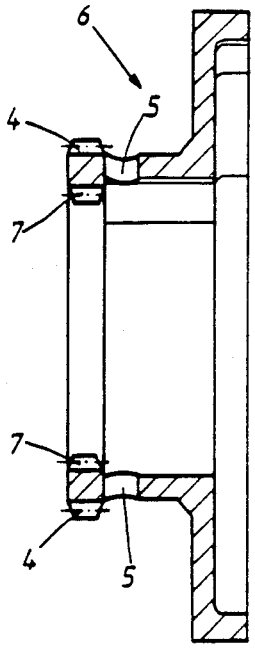
Fig. 3
Fig. 4
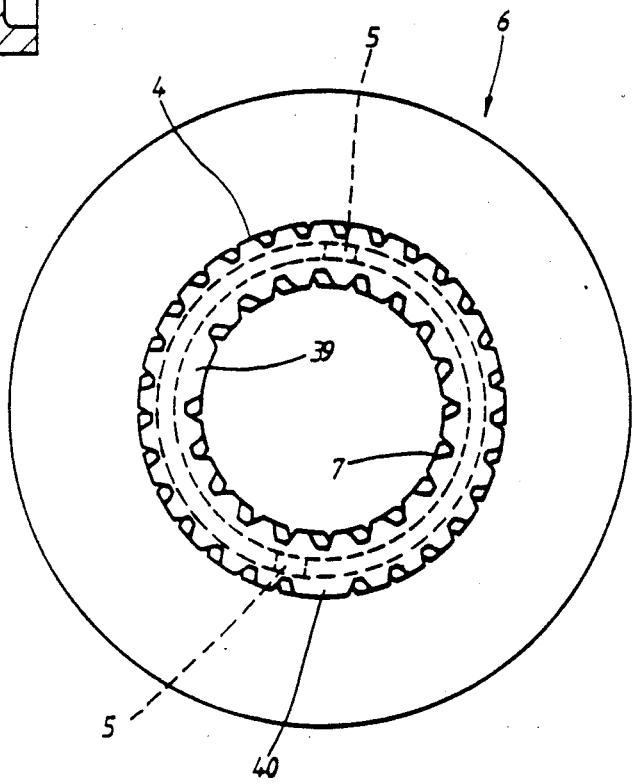

DEVICE FOR RELATIVE ANGULAR ADJUSTMENT BETWEEN TWO DRIVINGLY CONNECTED SHAFTS

BACKGROUND AND SUMMARY OF THE INVENTION

The present invention generally relates to a device for providing relative angular adjustment between at least two drivingly connected shafts and more particularly to such a device having a compact design and reliable operation.

German Published Unexamined Patent Application (DE-OS) No. 3,126,620 discloses a device for altering the phase setting between an engine shaft and a control shaft in the case of engines which have two separate control shafts for intake valves and outlet valves, the device permitting alternation between two different timing settings. Each of the two timing settings corresponds to one end position of a movable driving member which is connected to an engine shaft and a control shaft via couplings, of which at least one is provided with a helical toothing, and by axial displacement brings about a rotation of the control shaft relative to the engine shaft.

The adjustment of the driving member into one of the end positions is effected by the prestress of a spring, while the adjustment into the other end position is effected via pressure oil from the engine oil circuit. A centrifugally actuated slide assumes three different positions depending on the engine speed, in which positions it correspondingly opens and closes oil discharge bores and hence controls the oil pressure on the driving member. In a slide position opening an oil discharge bore, below a certain engine speed, the driving member is acted upon by a spring force only, which holds the driving member in one end position.

If the engine speed exceeds this first threshold value, the slide closes the oil discharge bore as a result of the change in the centrifugal force and the driving member is displaced axially counter to the spring stress by the increasing engine oil pressure into a second end position. As a result, a relative rotation takes place between the engine shaft and the control shaft and a timing setting matched to this engine operating condition is thereby achieved. After a further threshold value for the engine speed has been exceeded, the slide is moved into a position which makes an oil discharge possible again. By virtue of the spring force, the driving member is moved back into its first end position again, with corresponding relative rotation. The adjustment of the driving member when the engine speed falls below the threshold values takes place in the same manner.

German Published Unexamined Patent Application (DE-OS) No. 3,316,162 shows a comparable device, except that the actuation of the driving member is not controlled by centrifugal forces, the slide controlling the oil flow being electromagnetically actuatable instead.

Both devices mentioned above have the disadvantage that control takes place via an influencing of the oil discharge. In one of the two working positions of the driving member, a continuous oil flow with the associated losses is present.

A further disadvantage consists in the fact that, in the case of a resetting procedure into the starting position, the oil forced out of the working space by the driving member as a result of the spring force has to be discharged via the same oil discharge bore through which the oil, in this position of the slide, flows continuously is channelled. This state of affairs results in an undesirable slowing of the resetting procedure.

At low engine speeds, e.g. during idling, the oil pressure is too low to bring about an adjustment. For this reason, the driving member must be brought into the position corresponding to this operating condition by spring force. However, at low speed and hence also low oil pressure, such a spring force can hinder an adjustment of the driving member by pressure oil in those time periods in which a restraining camshaft torque is present, with the result that an adjustment can only take place when a driving camshaft torque is operative, i.e. intermittently. In order to avoid the undesired resetting of the driving member caused by the spring force together with the camshaft torque, the helical toothing must be of irreversible design, i.e. must be designed to have a shallow helix angle. However, such a helix angle also permits only a short adjustment path, i.e. the relative angular adjustment between engine shaft and control or camshaft is small, as is also, therefore, the influence of a timing alteration.

A similar adjusting device is also described in U.S. Pat. No. 4,305,367. Admittedly, this does not relate to a relative angular adjustment between an engine shaft or crankshaft and a control shaft or camshaft for setting the valve timing, as described in the two cited publications, but to an adjustment of a control shaft for an injection pump. In contrast to the above-indicated devices, the driving member, which is likewise provided with helical toothing and is designed as an annular piston, is subjected alternately to pressure oil from one side or the other, depending on the desired direction of movement. The pressure oil is supplied by means of a specially allocated oil pump via control devices and separate lines to the two working spaces, which are separated by the annular piston. Compared to an internal oil supply and control, this represents a considerably greater expenditure in terms of construction.

It is an object of the invention, while avoiding the disadvantages mentioned, to provide a device of the generic type in such a way that, in combination with compact design, an angular adjustment takes place reliably and quickly over a wide range, irrespective of the oil pressure.

It is another object of the present invention to provide a device for permitting angular adjustment between connected shafts which is relatively simple to construct in an inexpensive manner and provides a large range of angular adjustment relative to a simultaneously short axial adjustment path.

These and other objects are achieved according to the teachings of the present invention by eliminating the need for a spring member to return the driving member to its original position due to a unique arrangement driven essentially by hydraulic pressure to provide a greater positioning movement without the need for continuous oil flow. Further embodiments and advantages of the invention will become evident from the appended claims and following the description.

According to certain advantageous features of preferred embodiments of the present invention, a sprocket wheel, which is driven by a crankshaft via a chain connection, is mounted on a sprocket wheel carrier designed as a hollow shaft and having an inner helical toothing. A positioning piston provided with a corresponding outer helical toothing is guided in the sprocket wheel carrier so as to be axially movable. Via its likewise helical inner toothing, this piston is connected in an axially displaceable manner to an outer helical toothing of a hollow flanged shaft rigidly connected to the camshaft.

Sprocket wheel carrier, camshaft and flanged shaft together form an annular hollow space which is divided by the positioning piston into two working spaces. Arranged in the hollow flanged shaft is a control piston which has two working positions, is held in one of the these working positions by a spring and can be moved by an armature, rigidly connected to it, of an electromagnet fixed in relation to the engine into the other working position, counter to the force of the spring. Depending on the position of the control piston the feeding of pressure oil from the engine oil circuit via the oil bore of the camshaft is possible via an annular space formed by the control piston and via oil feed bores to one of the two working spaces.

The control piston simultaneously blocks the discharge from the second working space, which is shut off from the oil feed, for the purpose of emptying the latter via a longitudinal bore in the interior of the control piston and a bore in the camshaft. The positioning piston is adjusted by hydraulic pressure only in both directions and does not require a separate spring force for resetting.

Thus no spring force has to be overcome during the adjustment of the positioning piston and a greater positioning moment can be achieved as a result. Since the particular working space under pressure is shut off from the oil discharge, a continuous oil flow does not take place either. Oil flow only takes place in the time periods corresponding to the emptying of the particular working space, i.e. during an adjustment procedure until one of the two working positions is reached.

In the base position, the electromagnet is preferably de-energized and the control piston is held in one end position by the spring. After the magnet is switched on, the control piston is moved into the other end position counter to the spring force. By virtue of the resulting feeding of pressure oil into one of the two working spaces, the positioning piston is displaced axially and, via the helical toothing, rotates the flanged shaft, and hence also the camshaft, relative to the sprocket wheel driven by the crankshaft.

Oil is pushed out of the other working space in the particular case by the axial displacement of the positioning piston and is discharged to the engine oil circuit. When the electromagnet is switched off, the control piston returns to its starting position with the aid of the spring force, permits oil discharge from the working space which has up to this time been under pressure and feeds pressure oil to the other working space. By means of this renewed positioning procedure, the previous rotation is reversed again.

Other objects, advantages and novel features of the present invention will become apparent from the following detailed description of the invention when considered in conjunction with the accompanying drawings.

BRIEF DESCRIPTION OF THE DRAWINGS

FIG. 3 shows a positioning piston, in accordance with the teachings of the present invention on an enlarged scale and in section, and FIG. 4 shows the positioning piston of FIG. 3 seen from the side facing away from the camshaft.

DETAILED DESCRIPTION OF THE DRAWINGS

An exemplary embodiment of the invention will be explained below with reference to the drawings.

Figure 1:
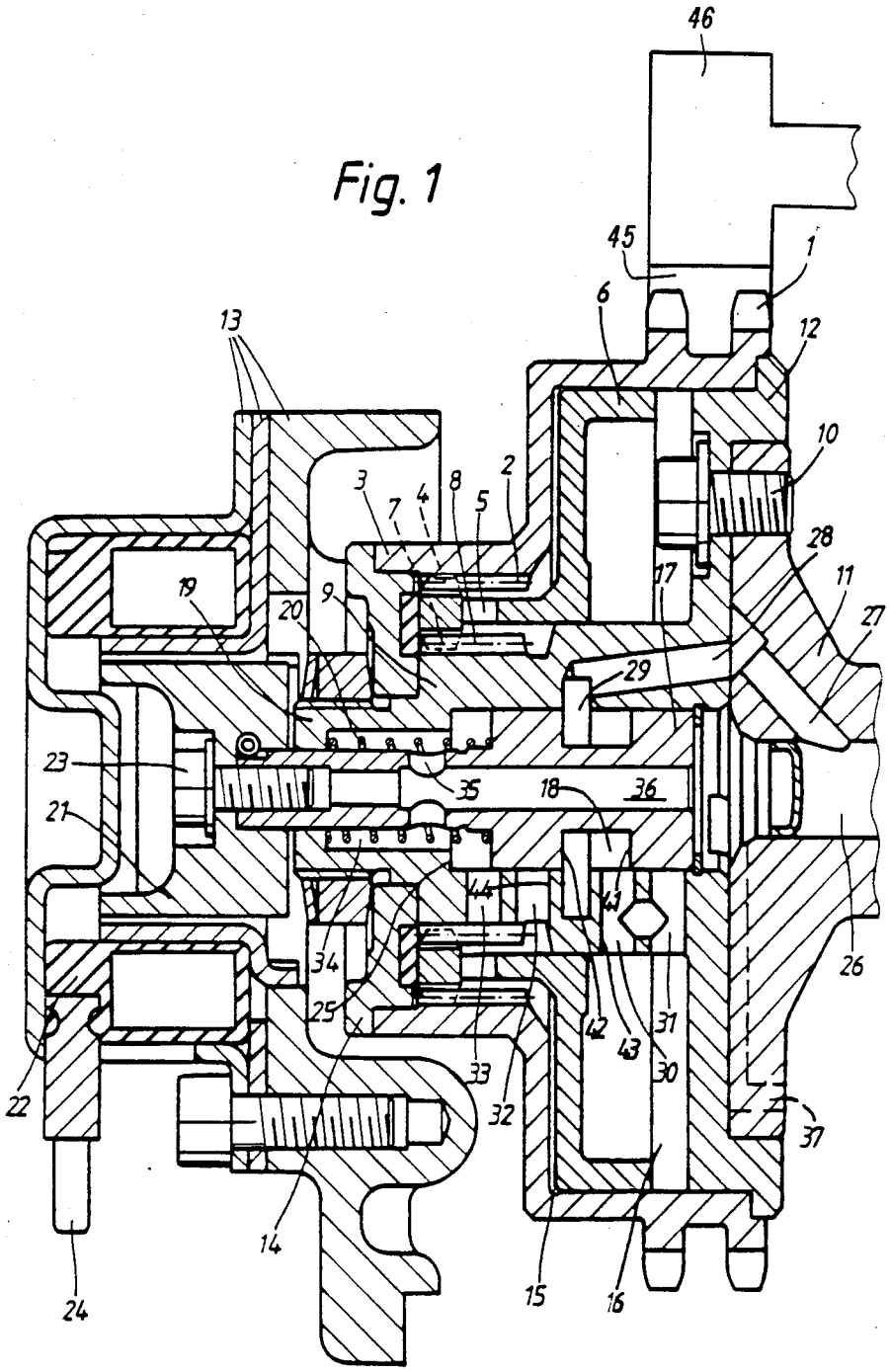
FIG. 1 shows a device according to the teachings of the invention, in section and in a base position.

FIG. 1 shows an adjusting device according to the teachings of the invention. A sprocket wheel 1 driven via, for example, a chain, 45 or the like, by a crankshaft 46 is mounted on a sprocket wheel carrier 3 provided with an inner helical toothing 2. An annular positioning piston 6 provided with an oil bore 5 is arranged so as to be axially displaceable and rotatable in the sprocket wheel carrier 3 via a corresponding outer helical toothing 4. On its inside, in turn, the positioning piston 6 has a helical toothing 7, via which it is positively connected to a flanged shaft 9 via an outer helical toothing 8 so as to be likewise axially displaceable and rotatable. This flanged shaft 9 is secured on a camshaft 11 via a screw connection 10. The sprocket wheel carrier 3 is supported rotatably on the camshaft end 12 of the flanged shaft 9 and on a cover 14 facing a part 13 fixed to the engine housing. Together with the cover 14, sprocket wheel carrier 3 as well as flanged shaft 9 and camshaft 11 form an annular space, which is divided into two working spaces 15 and 16 by the longitudinally displaceable positioning piston 6.

Via the two helical toothings 2, 4 and 7, 8, an axial displacement of the positioning piston 6 brings about a relative rotation of the flanged shaft 9 and hence also of the camshaft 11 with respect to the sprocket wheel 1, i.e. with respect to the crankshaft. The division of a helical toothing into the two helical toothings 2, 4 and 7, 8 shown here permits a reduction of the helix angle of each of the individual helical toothings while retaining the same longitudinal adjustment path. In this way, a large range for the angular adjustment can be achieved with a simultaneously short axial adjustment path. This fact permits a short and space-saving design of the adjustment device.

The helix angles of the two helical toothings 2, 4 and 7, 8 are preferably selected so as to be identical, permitting production with the same tool in the same chucking set-up and thus more rapid production, and increasing the truth of running.

Within the hollow flanged shaft 9 there is arranged a control piston 17 having a circumferential oil groove 18 which can be moved in the direction of its longitudinal axis and is pressed into its base position in the direction of the camshaft 11 by a spring 20 supported on one end 19 of the flanged shaft 9. At that side of the control piston 17 rotating with the adjusting device which faces away from the camshaft 11, an armature 21 of an electromagnet 22 fixed in relation to the engine is connected to said control piston via a screw connection 23. The electromagnet 22 is designed as an annular magnet in which the armature 21 is inserted so as to be freely rotatable.

The electromagnet is electrically connected to a control device (not shown here) via a terminal 24. When an electric voltage is applied to the electromagnet 22 by the control device, the rotating armature 21 is moved in the direction of the electromagnet 22 and thereby brings the control piston 17 rigidly connected to it, counter to the force of the spring 20, out of its base position into the working position, in which the control piston 17 rests against a surface 25 of the flanged shaft 9, said surface lying opposite the camshaft 11. The position of this surface 25 is selected such that the axial adjustment path of the control piston 17 is limited in such a way that the armature 21, in its working position, does not come into contact with a housing part of the electromagnet (22).

In this way, no friction occurs between the rotating armature 21 and the stationary housing. The control piston 17 remains in this working position for as long as voltage is applied to the electromagnet 22 and only moves back towards the camshaft 11 and into its base position under the actuating force of the spring 20 when this voltage has been switched off.

In the de-energized condition of the electromagnet 22, the control piston 17, held by the force of the spring 20, is in its base position shown here. Via a longitudinal oil bore 26 in the camshaft 11, a connecting bore 27 and a flanged-shaft oil bore 28 having a circumferential annular groove 29, lubricating oil passes under pressure out of the engine oil circuit into the circumferential oil groove 18 of the control piston 17. The flanged shaft 9 has a radial oil feed bore 30 which leads to the first working space 16 and, in this position of the control piston, communicates with the oil groove 18.

By virtue of the position of the control piston 17, as shown in FIG. 1, the oil discharge bore 31 from this working space 16 is simultaneously closed, with the result that the positioning piston 6 is brought into its base position away from the camshaft 11 by the oil pressure. Oil which was previously situated in the second working space 15 and, in this position, is nonpressurized since the second oil feed bore 32 is closed by the control piston 17, can pass out of the working space 15, via the toothing 2, 4, the oil bore 5 in the positioning piston 6, the second toothing 7, 8 and a second, radial oil discharge bore 33 in the flanged shaft 9, into the control piston space 34, from where it flows back to the engine oil circuit via radial bores 35 and a longitudinal bore 36 of the control piston 17 and a channel 37 arranged in the camshaft 11.

Figure 2:
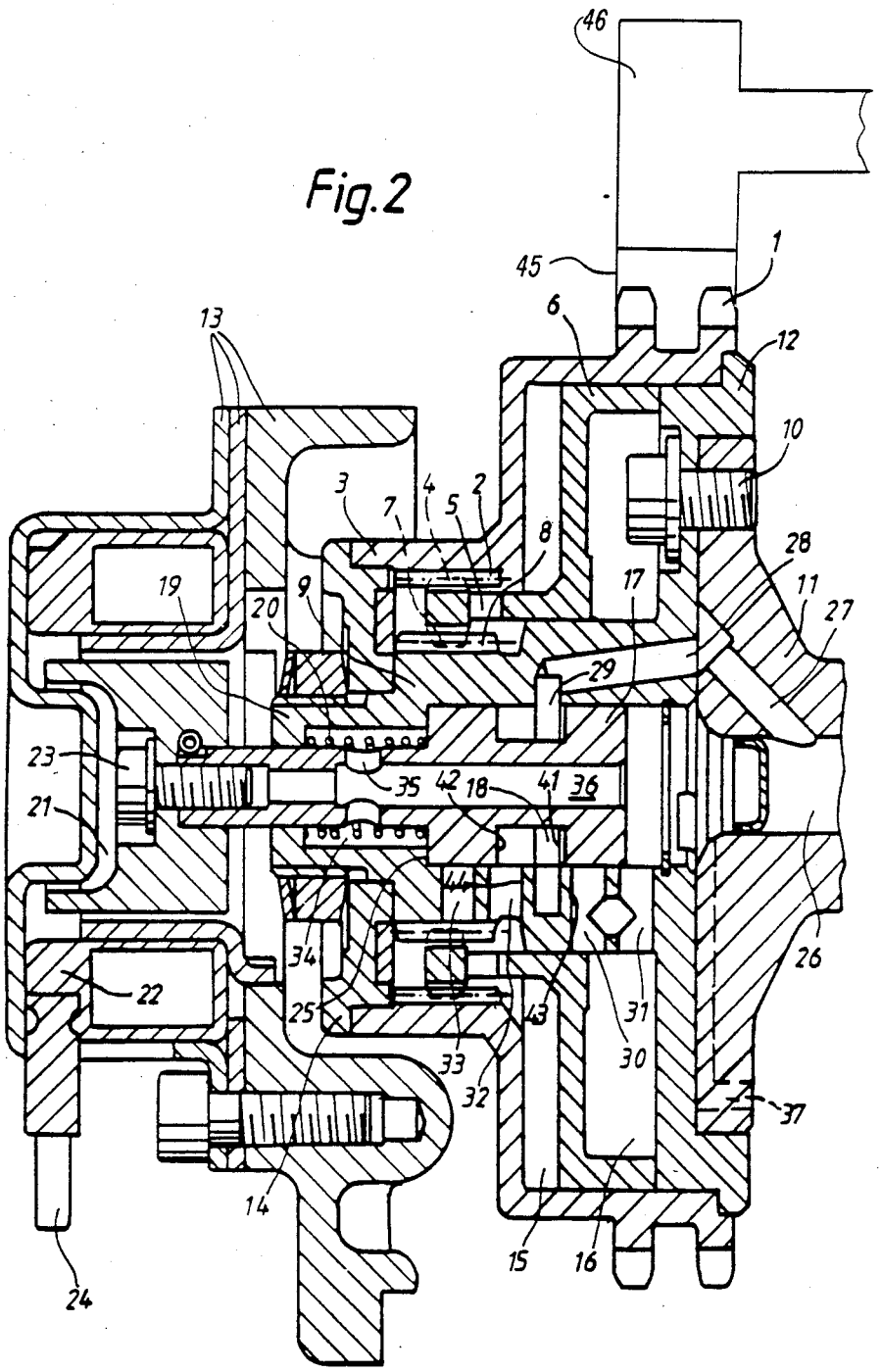
FIG. 2 shows the device according to the teachings of the invention, as illustrated in FIG. 1 and in a working position.

In FIG. 2, the device according to the invention and according to FIG. 1 can be seen in its working position. The individual parts correspond to those in FIG. 1 and identical parts bear the same reference numerals as in FIG. 1.

Actuated by the control device, the electromagnet 22 attracts the armature 21 and the control piston 17 connected to the latter, counter to the force of the spring 20, to an extend such that the control piston comes to rest by a shoulder against a surface 25 of the flanged shaft 9, said surface lying opposite the camshaft 11. Pressure oil from the engine oil circuit passes out of the longitudinal oil bore 26 of the camshaft 11, as described above, into the circumferential oil groove 18 of the control piston 17. By virtue of the changed position of the control piston 17, the oil feed bore 30 to working space 16 is closed, but the oil discharge bore 31 is opened.

During the adjusting movement of the positioning piston 6, oil situated in working space 16 can be forced out into the channel 37 via this bore 31 and a control piston space 38 on the camshaft side and be fed back to the engine oil circuit. Oil flow into the second working space 15 via the longitudinal bore 36, the radial bores 35 and the control piston space 34 is here made impossible by the position of the control piston 17. Via the opened second oil feed bore 32, the pressure oil passes out of the circumferential oil groove 18 to the oil bore 5 of the positioning piston 6 into working space 15. The positioning piston 6 is thereby displaced axially towards the camshaft 11 and, as described above, forces oil out of the working space 16.

By virtue of the helical toothings 2, 4 and 7, 8, the camshaft 11 undergoes a relative rotation with respect to the driven sprocket wheel 1 during the longitudinal displacement of the positioning piston 6. However, this working position is maintained only as long as the electromagnet 22 is supplied with voltage via the control device. When the electromagnet 22 is switched off, the control piston 17 is pushed into its base position according to FIG. 1 by the spring 20 and the rotation of the camshaft 11 is reversed by the renewed longitudinal displacement of the positioning piston 6 into its base position.

The construction of the control piston 17 with its circumferential oil groove 18, and the arrangement of the oil feed and oil discharge bores 30, 32 and 31, 33 in relation to the control piston guarantees a small positioning path of the control piston 17 for the purpose of actuating the angular adjustment device and therefore also requires only a small electromagnet 22 in terms of dimensions and power consumption.

In addition, the positioning time can be kept low. This advantageous small positioning path is achieved by the fact that the width of the circumferential oil groove 18 of the control piston 17 between its two mutually facing guiding edges 41 and 42 is greater than the distance between the mutually opposed guiding edges 43 and 44 of the oil feed bores 30 and 32. This corresponds to overlapping oil conveyance in a certain short time period during the adjustment procedure. The adjustment path of the control piston 17 in the longitudinal direction of the camshaft axis need thus be no greater than the diameter of the oil feed bores 30, 32. This allowing the circumferential oil groove 18 to effectively cooperate with both the oil-carrying feed and return bores.

FIG. 3 shows a section through the positioning piston 6 from FIGS. 1 and 2, on an enlarged scale. Reference numeral 5 again designates the oil bores and reference numerals 4 and 7 represent the outer and inner helical toothing respectively.

The same positioning piston 6 from FIG. 3 is represented in FIG. 4, as seen from the side facing away from the camshaft. The oil bores 5 are drawn in as being hidden, while the helical toothings 4 and 7 can be clearly seen. The inner helical toothing 7 has a block tooth 39 and the outer helical toothing 4 has a block tooth 40.

In this exemplary embodiment, the block teeth 39 and 40 are designed as a tooth in each case twice as wide as the other teeth. These block teeth facilitate the assembly of the adjusting device, since they bring the parts to be assembled, i.e. sprocket wheel carrier 3, positioning piston 6 and flanged shaft 9, into a precisely defined position with respect to one another. Assembly errors with respect to the correct installation of these parts in terms of their angle are thereby excluded.

The advantages of the double helical toothing have already been discussed above. However, it can easily be seen from this figure that this double helical toothing can be produced in a simple manner in just one work chucking set-up.

The base position shown in FIG. 1 of the adjusting device is expediently selected such that it corresponds to a retardation of the camshaft for the intake valves. This retarded setting is provided for idling and full-load operation, since in it the performance is set to an optimum. By means of a late end to intake, scavenging effects can be utilized at high speeds and by means of a retarded beginning to intake, a slight valve overlap can be achieved, the idling speed reduced and the idling behavior improved.

The working position shown in FIG. 2 of the adjusting device corresponds to an advance of the intake camshaft and should be set in the central speed range. This fact is equivalent to an improvement of the torque in this speed range, in which an internal combustion engine is normally operated during driving.

Although it is conceivable to reverse the allocation of the working positions of the adjusting device to these operating conditions of the internal combustion engine, since the electromagnet must be constantly switched on in the frequently used operating range comprising average speed, the allocation according to the invention has the advantage that, in the event of a failure of the electromagnet or its control, the internal combustion engine is both optimized for maximum performance and has a favorable starting and idling behavior.

If, during a starting procedure, the adjusting device is not in the base position which is favorable for this operating condition, it is automatically brought into this position by restraining camshaft moments even when oil pressure is still absent.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Device for relative angular adjustment between at least two drivingly connected shafts, including a first shaft and at least one second shaft, the at least one second shaft carrying at its driving end a positioning element which is axially displaceable, is directly connected to the at least one second shaft via a helical toothing and, via a further helical toothing, is directly connected to and axially displaceable relative to a cylindrical hollow shaft which surrounds the positioning element and carries a driving wheel, the positioning element being provided with a positioning piston which is arranged in an annular space formed by the hollow shaft and the driving end of the at least one second shaft, the positioning piston dividing the annular space into first and second working spaces and, for the angular adjustment of the driving wheel relative to the at least one second shaft, the positioning piston being displaceable between a first position and a second position by pressure oil from a lubricating oil circuit under pressure, oil of the lubricating oil circuit being fed into one of the first and second working spaces as a function of first and second positions of a control piston, and pressure oil being directable through an oil return back into the lubricating oil circuit from the other of the first and second working spaces by the control piston, wherein the adjustment of the positioning piston out of one of the first and second positions into the other of the first and second positions is effected by pressure oil being directed into one of the first and second working spaces by the control piston, wherein the control piston for controlling the pressure oil of the first and second working spaces is provided with a circumferential oil groove which cooperates with oil-carrying feed and return bores in the driving end of the at least one second shaft so that the oil return from a working space subjected to pressure is blocked and the oil return of a nonpressurized working space is opened, and wherein the circumferential oil groove of the control piston has a width between mutually facing guiding edges which is greater than the distance between mutually opposed guiding edges of oil feed bores of the first and second working spaces.

2. Device according to claim 1, wherein the helical toothings connecting the hollow shaft and the driving end of the camshaft via the positioning piston have the same helix angle.

3. Device according to claim 1, wherein at least one of the two helical toothings in each case has at least one block tooth.

4. Device according to claim 1, wherein an armature of an electromagnet for actuating the control piston is connected rotationally fast to the control piston.

5. Device according to claim 1, wherein the axial adjustment path of the armature is limited by a stop surface.

6. Device according to claim 1, wherein the first shaft is a crankshaft and the at least one second shaft is a camshaft.

7. Device according to claim 1, wherein the lubricating oil circuit is of an internal combustion engine.

8. Device according to claim 7, wherein the positioning piston assumes one of the first and second positions for optimizing the performance of the internal combustion engine in the event of a failure of the control piston.

* * * * *